United States Patent [19]

Morris

[11] Patent Number: 5,046,276

[45] Date of Patent: Sep. 10, 1991

[54] SAFETY CAP

[76] Inventor: James K. Morris, 312 N. Stadium Way, Apartment #402, Tacoma, Wash. 98403

[21] Appl. No.: 526,053

[22] Filed: May 21, 1990

[51] Int. Cl.[5] ..... F41A 17/00

[52] U.S. Cl. ..... 42/70.01; 42/96; 273/317; 124/83

[58] Field of Search ..... 42/70.01, 96, 106, 1.08; 89/14.5, 14.6, 30; 124/83, 1; 273/317

[56] References Cited

U.S. PATENT DOCUMENTS

| | | | |
|---|---|---|---|
| 889,644 | 6/1908 | Szemerey | 42/106 |
| 3,063,184 | 11/1962 | Sukala | 42/106 |
| 3,354,571 | 11/1967 | Parker | 42/106 |
| 4,040,331 | 8/1977 | Litman | 89/14.5 |
| 4,817,322 | 4/1989 | Dietz et al. | 42/96 |

FOREIGN PATENT DOCUMENTS

| | | | |
|---|---|---|---|
| 76136 | 1/1950 | Norway | 42/96 |
| 12087 | 6/1916 | United Kingdom | 42/96 |

*Primary Examiner*—Michael J. Carone

*Attorney, Agent, or Firm*—Cassidy, Vance & Tarleton

[57] ABSTRACT

A safety cap (10) having a sleeve (12) with a screen mesh (14) for slidable engagement with a gun barrel (16) to fragment an unintentionally discharged jelled paint pellet. The sleeve (12) has a longitudinal axially bore (22) sized and shaped to be slidably received over the gun barrel (16) with a tight fit. The plurality of filaments (34) on the screen mesh (14) form openings (36) that are sized and shaped to fragment the jelled paint pellet and permit all of the fragments of the jelled paint pellet to exit the gun barrel (16) to avoid plugging of the bore (18). A threadable fastener (52) can be used to secure the attachment of the safety cap (42) to the gun barrel (50).

16 Claims, 1 Drawing Sheet

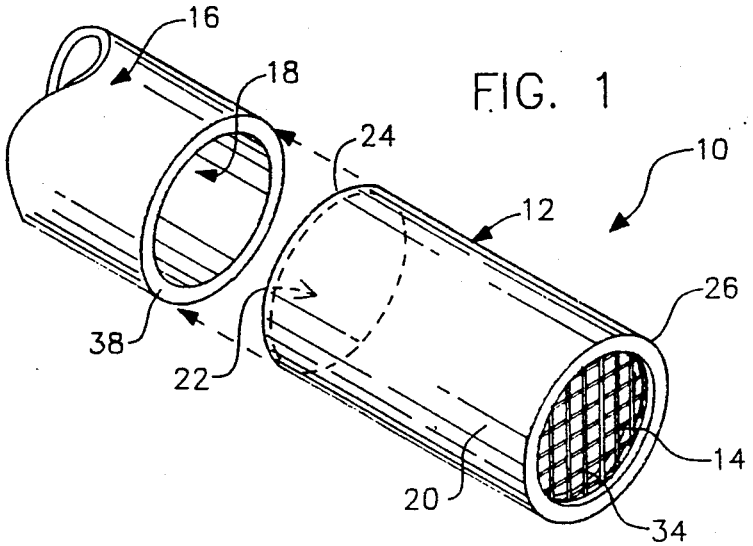
FIG. 1
FIG. 2
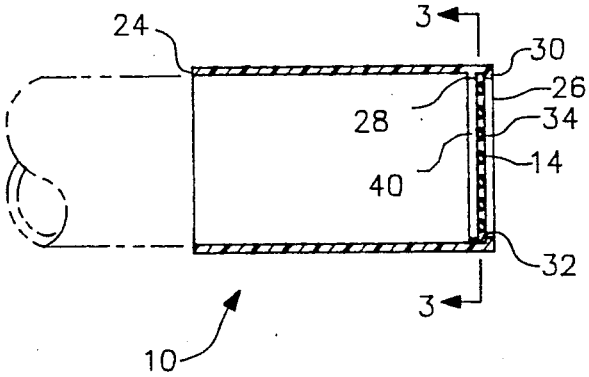
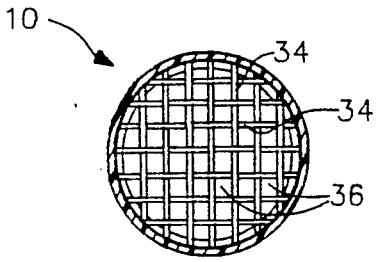
FIG. 3
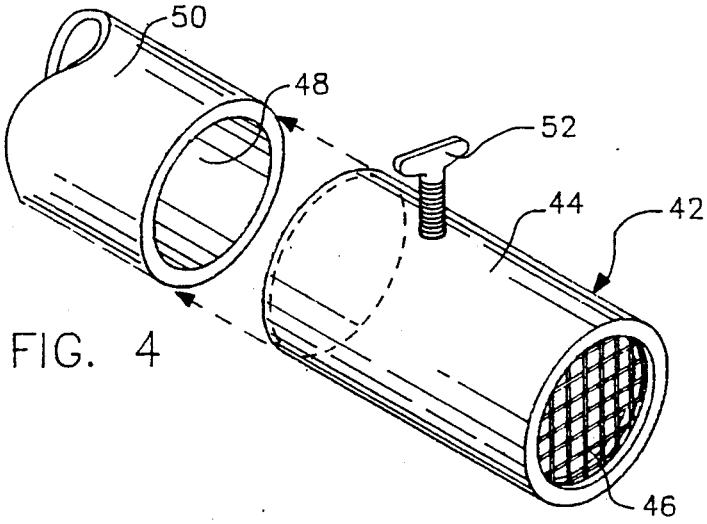
FIG. 4

SAFETY CAP

TECHNICAL FIELD

The present invention pertains to safety devices for jelled paint pellet guns, and, more particularly, to a safety cap for a jelled paint pellet gun barrel that fragments a jelled pellet of paint that is discharged from the gun barrel.

BACKGROUND OF THE INVENTION

Modern versions of field games, such as "Capture the Flag", and other strategic pursuit activites utilize paint pellets discharged from a gun as a visual indicator of a "hit" on a player or target. Typically, these paint pellets are spherical projectiles formed of jelled paint that are launched or fired from pistols and rifles powered by a compressed gas, such as $CO_2$. Jelled paint pellets are loaded into a gun individually through a loading tube. In order to avoid permanent marking of an object or a player, and to avoid permanent damage to the environment, these paint pellets are typically formed of water soluble paint jell that is hardened into a round ball.

A serious danger in the use of these jelled paint pellets is the injury that can occur if the paint pellet is accidentally discharged at close range to another player. Because these jelled paint pellets are relatively hard and are dishcarged at several hundred feet per second, they can easily penetrate an eye, enter the mouth, or cause other serious injury. While most all guns used with paint pellets have safety devices on their triggers that prevent pulling of the trigger when the safety device is on, there are many times when it is not practical to have the safety device on or when it is accidentally left off. Consequently, there is a need in the art for a safety cap that can be quickly and easily placed over the discharge end of the gun barrel and cover the end of the barrel with a screen mesh or similar type of filaments such that when a jelled paint pellet is unintentionally discharged from the gun barrel, it will fragment as it passes through the mesh and disperse in the air. Furthermore, it is desirable that such a device prevent jamming of the gun barrel with fragmented paint by allowing substantially all of the jelled paint pellet to exit the gun barrel as it passes through the safety cap device.

SUMMARY OF THE INVENTION

The present invention is directed to a safety cap for a jelled paint pellet gun barrel that comprises a fragmenting device that fragments the jelled paint pellet as it is discharged from the gun barrel and a attaching member for removably attaching the framenting device to the discharge end of the gun barrel.

In accordance with another aspect of the present invention, the fragmenting device is preferably constructed of a plurality of filaments to create a mesh having openings that are sized to fragment the jelled pellet of paint as it exits the gun barrel and permits substantially all of the jelled paint pellet to exit the gun barrel as it is fragmented.

In accordance with yet another aspect of the present invention, the attaching member is preferably formed in the shape of a sleeve having a longitudinal axial bore that is sized and shaped to be slidably received over the end of the gun barrel with a right fit.

In accordance with yet another aspect of the present invention, the safety cap also includes a securing member that securely attaches the sleeve to the gun barrel to prevent unintentional removal of the sleeve when it is subjected to the force of a discharged jelled paint pellet. Preferably, this securing member can be a set screw threadably engaged with the sleeve to bear against the gun barrel.

In accordance with yet another aspect of the present invention, the screen or filament mesh is secured in a groove formed in one end of the sleeve such that the mesh remains in place when subjected to the force of a discharged jelled paint pellet.

As will be readily appreciated from the foregoing description, the safety cap is quickly and easily mounted to the discharge end of the gun barrel and secured in place so that it cannot be removed. The screen mesh is sized and shaped to fragment the jelled paint pellet as it passes therethrough without blocking the barrel or causing other damage to the gun. By preventing the jelled paint pellet from leaving the gun barrel in a "whole" state, serious injury to nearby players or damage to other objects is avoided.

BRIEF DESCRIPTION OF THE DRAWINGS

The foregoing and other features and advantages of the present invention will be more readily appreciated as the same becomes better understood from the following detailed description of a representative embodiment of the invention when considered in conjunction with the accompanying drawings wherein:

FIG. 1 is an isometric view of a safety cap formed in accordance with the present invention;

FIG. 2 is a cross-sectional view of the safety cap of FIG. 1;

FIG. 3. is a cross-sectional view of the safety cap of FIG. 2 taken along lines 3—3; and FIG. 4 is an isometric view of an alternative embodiment of the safety cap formed in accordance with the present invention.

DETAILED DESCRIPTION OF THE PREFERRED EMBODIMENT

FIGS 1-3 illustrate a representative embodiment of the safety cap 10 formed in accordance with the present invention. The safety cap 10 includes a sleeve 12 having a screen mesh 14 mounted therein and positioned for slidable engagement with a gun barrel 16. The particular gun barrel 16 illustrated is one used with jelled paint pellets (not shown) that are discharged through the barrel 16 and exit out the bore 18.

The sleeve 12 consists of a cylindrical wall 20 having a longitudinal axial bore 22 formed therethrough that communicates with a first end 24 and a second end 26. Ideally, the first end 24 is sized and shaped to be slidably received over the exterior of the gun barrel 16 with a tight fit. To facilitate slidable engagement of the sleeve 12 with the gun barrel 16, the sleeve 12 should be constructed of compliant material, such as a hard rubber or other similar synthetic substitute. By having the tight fit, the sleeve 12 will not unintentionally be pulled off the barrel by contact with another object or by the force of the jelled paint pellet as it exists the gun barrel and passes through the screen mesh 14.

The second end 26 of the sleeve 12 has two circumscribing flanges 28 and 30 formed therein to define a groove 32, as shown more clearly in FIG. 2, into which the screen mesh 14 is received and held in place. It is to be understood however, that other methods may be used for retaining the screen mesh 14 in the sleeve 12 without departing from the spirit and scope of the invention.

The screen mesh 14 is preferably formed of a plurality of intersecting filaments 34 that define openings 36 which are sized and shaped to fragment a discharged jelled paint pellet while also allowing all of the fragments of the jelled paint pellet to exit the bore 18 of the gun barrel 16. This is important to prevent blockage of the bore 18 or other damage to the equipment. Ideally, the screen mesh 14 is sized to completely cover the bore 18 of the gun barrel 16 when the safety cap 10 is mounted thereon. However, fewer filaments 34 may be used, which will result in larger openings 36 being formed, the selection of which will depend on the size and velocity of the jelled paint pellets being used with the particular gun.

FIG. 2 illustrates the safety cap 10 mounted to the gun barrel 16. When the safety cap 10 is completely slid onto the gun barrel 16, the first flange 28 will contact the forward face 38 of the gun barrel 16, creating a small gap 40 between the screen mesh 14 and the bore 18. Mounting and removel of the safety cap 10 is accomplished by twisting the sleeve 12 as it is being pushed or pulled on the gun barrel 16.

FIG. 4 illustrates an alternative embodiment of a safety cap 42 formed in accordance with the present invention to include a sleeve 44 and a screen mesh 46. In this embodiment the sleeve 44 may be formed of harder, less compliant material, such as aluminum, or other metal. The axial bore 48 is sized to permit the sleeve to be slidably received over the gun barrel 50 with a somewhat snug fit. To securely attach the sleeve 44 to the gun barrel 50, a threaded fastener 52, which is a thumb screw illustrated in FIG. 4, is threadably engaged with the sleeve 44 to protrude through the sleeve 44 and bear against the gun barrel 50. In this manner, the safety cap 42 is fixedly attached to the gun barrel 50 and cannot be removed by pulling until the threadable fastener 52 is unthreaded and released from engagement with the gun barrel 50. This embodiment of the safety cap 42 provides extra insurance that the safety cap 42 will not be unintentionally removed from the gun barrel 50.

While a preferred embodiment of the invention has been illustrated and described, it is to be understood that various changes may be made therein without departing from the spirit and scope of the invention. For instance, the plurality of filaments 34 that make up the screen mesh 14 may be constructed by any suitable material that is strong enough to withstand a high velocity impact from a hardened jelled paint pellet. For instance, these filaments may be formed of tautly stretched wire, string, or other similar material. In addition, the filaments 34 may be constructed of thin metal slats that can be angled to direct the jelled paint pellet fragments in a predetermined direction. Consequently, it is to be understood that various changes can be made therein without departing from the spirit and scope of the invention. Consequently, the scope of the invention is to be determined by the scope of the claims that follow.

The embodiments of the invention in which an exclusive property or privilege is claimed are defined as follows:

1. A safety cap for a gun barrel; comprising:

means for fragmenting a jelled pellet of paint as it is discharged from the gun barrel, said fragmenting means being positioned substantially across the discharge end of the gun barrel; and means for removably attaching said fragmenting means to the discharge end of the gun barrel.

2. The safety cap of claim 1, further comprising means for securing said attaching means to the gun barrel to prevent unintentional removal from the gun barrel.

3. The safety cap of claim 2, wherein said fragmenting means is sized and shaped to totally cover the discharge end of the barrel.

4. A safety cap for a gun barrel, comprising:

means for fragmenting a jelled pellet of paint as it is discharged from the gun barrel such that substantially all of the jelled paint pellet exits the barrel in a fragmented state, said fragmenting means being positioned across the discharge end of the gun barrel; and means for slidably attaching said fragmenting means to the discharge end of the gun barrel such that said attaching means remains on the gun barrel when a jelled paint pellet is discharged through said fragmenting means.

5. The safety cap of claim 4, whereby said attaching means comprises a sleeve member having an internal axial bore sized and shaped to engage the gun barrel with a tight fit.

6. The safety cap of claim 5, wherein said sleeve member is formed of a compliant material.

7. The safety cap of claim 5 further comprising a means for securing said sleeve to the gun barrel to prevent unintentional removal of said sleeve from the gun barrel.

8. The safety cap of claim 4, wherein said fragmenting means comprises a screen mesh.

9. The safety cap of claim 8, wherein said screen mesh has openings sized to fragment the jelled pellet of paint as it is discharged from the gun barrel and to permit substantially all of the jelled paint pellet to exit the gun barrel.

10. The safety cap of claim 9, wherein said attaching means comprises a sleeve member having an internal axial bore sized and shaped to engage the gun barrel with a tight fit.

11. The safety cap of claim 10, wherein said sleeve member is formed of a compliant material.

12. The safety cap of claim 10, further comprising means for securing said sleeve to the gun barrel to prevent unintentional removal of said sleeve from the gun barrel.

13. A safety cap for a gun barrel, comprising:

a tubular sleeve having a longitudinal axial bore sized and shaped to slide over the discharge end of the gun barrel with a tight fit; and a screen mesh having a plurality of filaments forming a plurality of openings that are sized to fragment a jelled paint pellet that is discharged from the gun barrel while allowing substantially all of the jelled paint pellet to exit the gun barrel.

14. The safety cap of claim 13, wherein said sleeve includes a groove formed at one end in which said screen mesh is securely received.

15. The safety cap of claim 13, further comprising a set screw threadably engaged with said sleeve to protrude through said sleeve and bear against the gun barrel to securely attach said sleeve to the gun barrel.

16. A safety cap for a gun barrel, comprising:

a plurality of projections sized and shaped to extend at least halfway across the bore of the gun barrel to fragment a jelled pellet of paint into a plurality of particles as it is discharged from the gun barrel and to permit substantially all of the particles of jelled paint to exit the gun barrel, and means for removably attaching said plurality of projections to the discharge end of the gun barrel.

* * * * *